US006524119B2

(12) United States Patent
Kato et al.

(10) Patent No.: US 6,524,119 B2
(45) Date of Patent: Feb. 25, 2003

(54) CONNECTOR ADAPTED TO HANDLING OF DIFFERENT KINDS OF SIGNALS INCLUDING HIGH-SPEED SIGNALS

(75) Inventors: Nobukazu Kato, Fussa (JP); Tomohiko Tamada, Hamura (JP); Yuko Nakatomi, Akishima (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/880,611

(22) Filed: Jun. 13, 2001

(65) Prior Publication Data

US 2001/0055901 A1 Dec. 27, 2001

(30) Foreign Application Priority Data

Jun. 26, 2000 (JP) ..... 2000-190976

(51) Int. Cl.[7] ..... H01R 12/00
(52) U.S. Cl. ..... 439/79; 439/579; 439/497
(58) Field of Search ..... 439/79, 579, 109, 439/108, 610, 497

(56) References Cited

U.S. PATENT DOCUMENTS

| | | | | |
|---|---|---|---|---|
| 3,591,834 A | * | 7/1971 | Kolias | 361/776 |
| 4,484,792 A | | 11/1984 | Tengler et al. | |
| 4,762,500 A | * | 8/1988 | Dola et al. | 439/79 |
| 4,917,616 A | * | 4/1990 | Dember, Jr. et al. | 439/101 |
| 5,116,239 A | * | 5/1992 | Siwinski | 439/492 |
| 5,199,880 A | * | 4/1993 | Arai | 439/65 |
| 5,709,557 A | * | 1/1998 | Martin et al. | 439/79 |
| 5,738,537 A | | 4/1998 | Setoguchi et al. | 439/159 |
| 6,027,345 A | * | 2/2000 | McHugh et al. | 439/66 |
| 6,183,301 B1 | * | 2/2001 | Paagman | 439/608 |
| 6,247,969 B1 | * | 6/2001 | Niitsu | 439/607 |
| 6,261,107 B1 | * | 7/2001 | Takase et al. | 439/79 |

FOREIGN PATENT DOCUMENTS

| | | | |
|---|---|---|---|
| EP | 0 523 491 A1 | 1/1993 | H01R/13/658 |
| EP | 0 908 977 A2 | 4/1999 | H01R/23/70 |

* cited by examiner

*Primary Examiner*—Lynn D. Feild
*Assistant Examiner*—J. F. Duverne
(74) *Attorney, Agent, or Firm*—Michael Best & Friedrich, LLC

(57) ABSTRACT

In a connector in which a number of conductive contacts (23) are held by an insulator (21), the contacts are grouped into a plurality of contact groups (24) corresponding to intended uses, respectively. The contact groups are adjacent to one another in a first direction (A1). The contacts in each contact group are arranged in a second direction (A2) perpendicular to the first direction. The contact groups have a specific contact group which is located outermost in the first direction and assigned to high-speed signals.

13 Claims, 15 Drawing Sheets

RELATED TECHNIQUE

CONNECTOR ADAPTED TO HANDLING OF DIFFERENT KINDS OF SIGNALS INCLUDING HIGH-SPEED SIGNALS

BACKGROUND OF THE INVENTION

This invention relates to a connector comprising a plurality of conductive contacts arranged in a coupling portion held by an insulator.

For example, an information processing apparatus such as a personal computer 10 illustrated in FIG. 1 transmits and receives various kinds of signals. For input and output of these signals, the personal computer 10 is provided with a plurality of connectors 11, 12, and 13 different in shape and typically formed on its rear side.

The connector 11 is intended to be connected to a connector 15 of a docking station 14 or a connector 17 of a port replicator 16. Each of the connectors 12 and 13 is adapted to be connected to a connector 19 of a peripheral device 18 such as a CD (Compact Disk) drive and a DVD (Digital Video Disk) drive. The docking station 14 and the port replicator 16 have connectors 21 and 22, respectively, which can be connected to the connector 19 of the peripheral device 18.

Thus, the personal computer 10 is adapted to be connected to various types of peripheral devices. Therefore, the connectors 11, 12, and 13 are supplied with various kinds of signals. These signals are different in speed and include a so-called high-speed signal. As well known, a line for transmission and reception of the high-speed signal is typically provided with a shield.

However, the connectors 11, 12, and 13 of the personal computer 10 are not classified in accordance with the kinds of the signals supplied thereto. Therefore, each of the connector 11, 12, and 13 may be supplied with the various kinds of signals. In this case, wiring for the connectors 11, 12, and 13 is complicated and therefore difficult.

In case where personal computers manufactured by different manufacturers are selectively connected, connection to the common peripheral device or the common docking station may be defective even if connectors of a same kind are used in the personal computers. This is because pin assignment of the connector is often different for each manufacturer as known in the art.

Furthermore, if connection to a particular circuit block alone is desired, a special connector for the particular circuit block must be separately equipped in the personal computer. This requires the connector cost and the mounting cost for the special connector.

SUMMARY OF THE INVENTION

It is therefore an object of this invention to provide a connector in which a number of contacts are grouped into a plurality of groups in a manner adapted to handle various kinds of signals including high-speed signals.

It is another object of this invention to provide an information processing apparatus equipped with the above-mentioned connector.

Other objects of this invention will become clear as the description proceeds.

According to this invention, there is provided a connector comprising an insulator and a number of conductive contacts held by the insulator, the contacts being grouped into a plurality of contact groups corresponding to intended uses, respectively, and adjacent to one another in a first direction, the contacts in each contact group being arranged in a second direction perpendicular to the first direction, the contact groups including a specific contact group which is located outermost in the first direction and assigned to high-speed signals.

DESCRIPTION OF THE PREFERRED EMBODIMENTS

Figure 1:
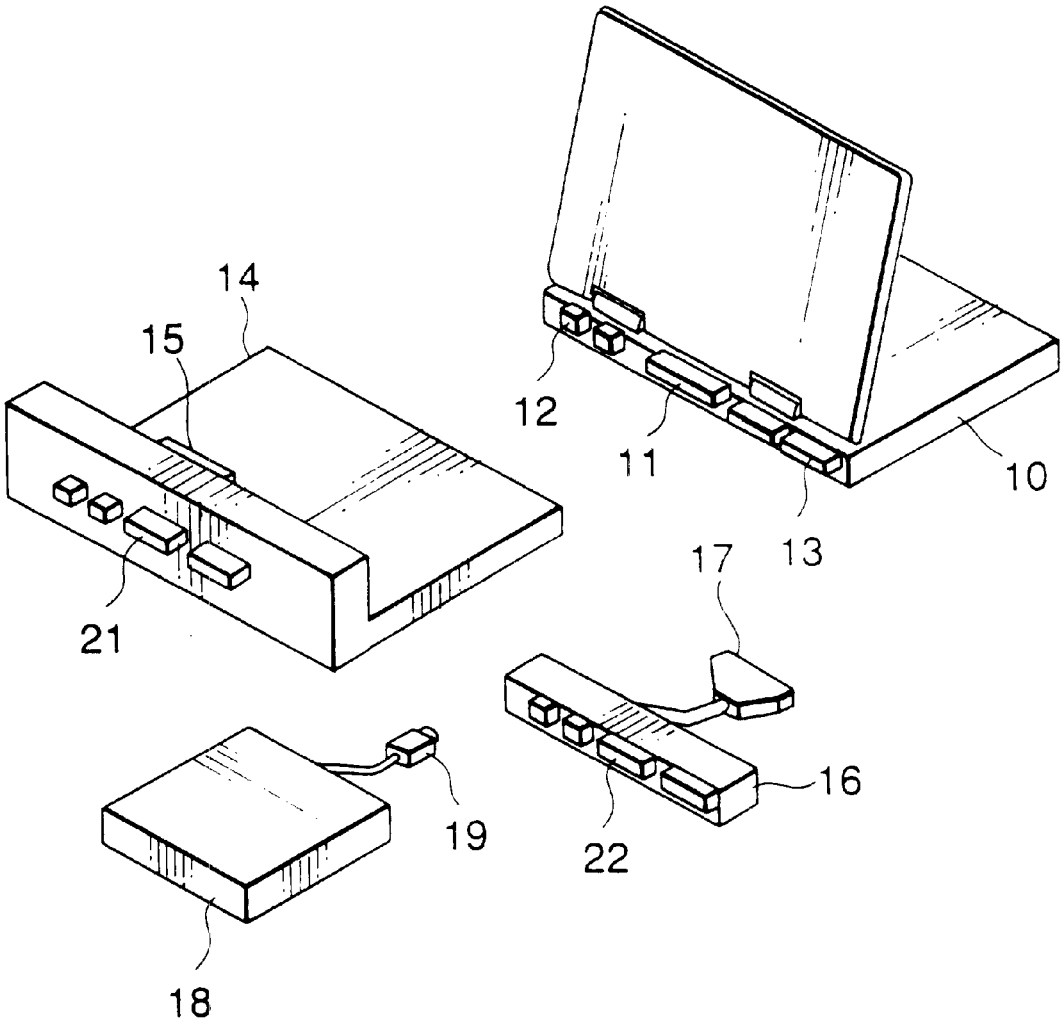
FIG. 1 is a perspective view for describing the use of a personal computer equipped with conventional connectors.
Figure 2A:
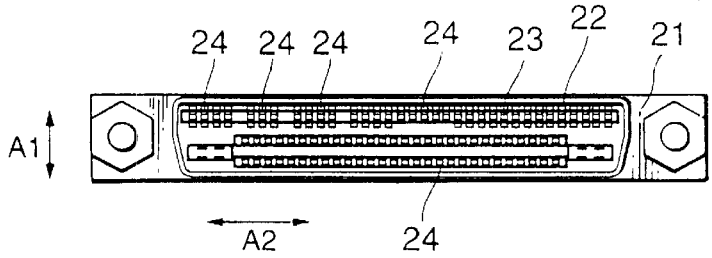
FIGS. 2A, 2B, and 2C are a front view, a plan view, and a right side view of a connector according to a first embodiment of this invention, respectively.
Figure 2B:
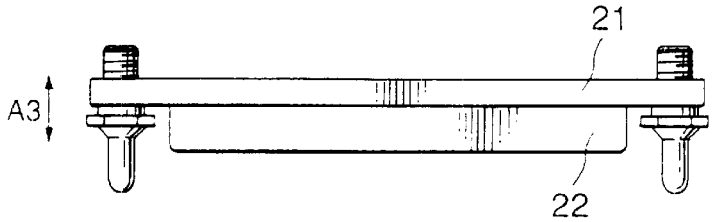
Figure 2C:
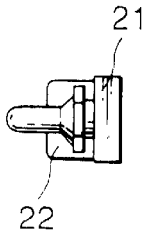
Figure 3:
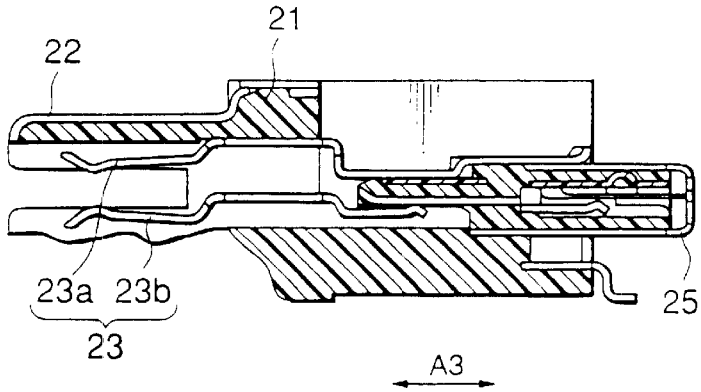
FIG. 3 is a sectional view of a characteristic part of the connector illustrated in FIGS. 2A to 2C.
Figure 4A:
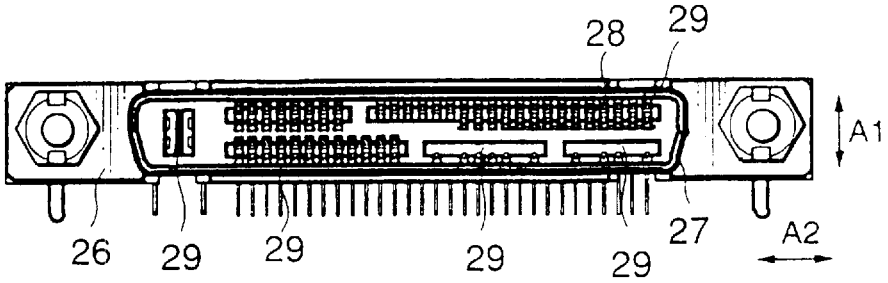
FIGS. 4A, 4B, and 4C are a front view, a plan view, and a right side view of a connector according to a second embodiment of this invention, respectively.
Figure 4B:
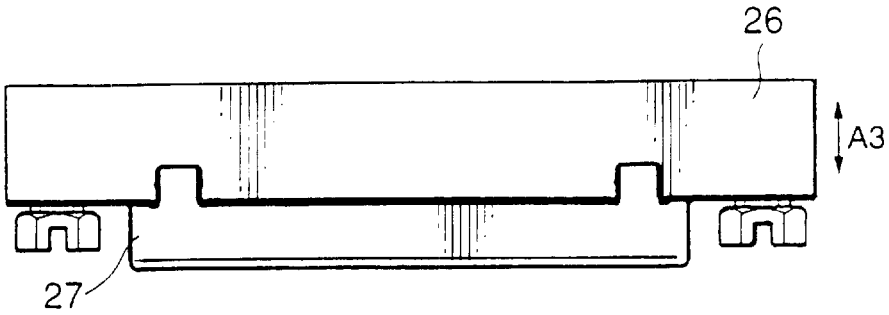
Figure 4C:
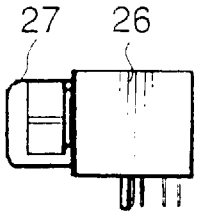
Figure 5:
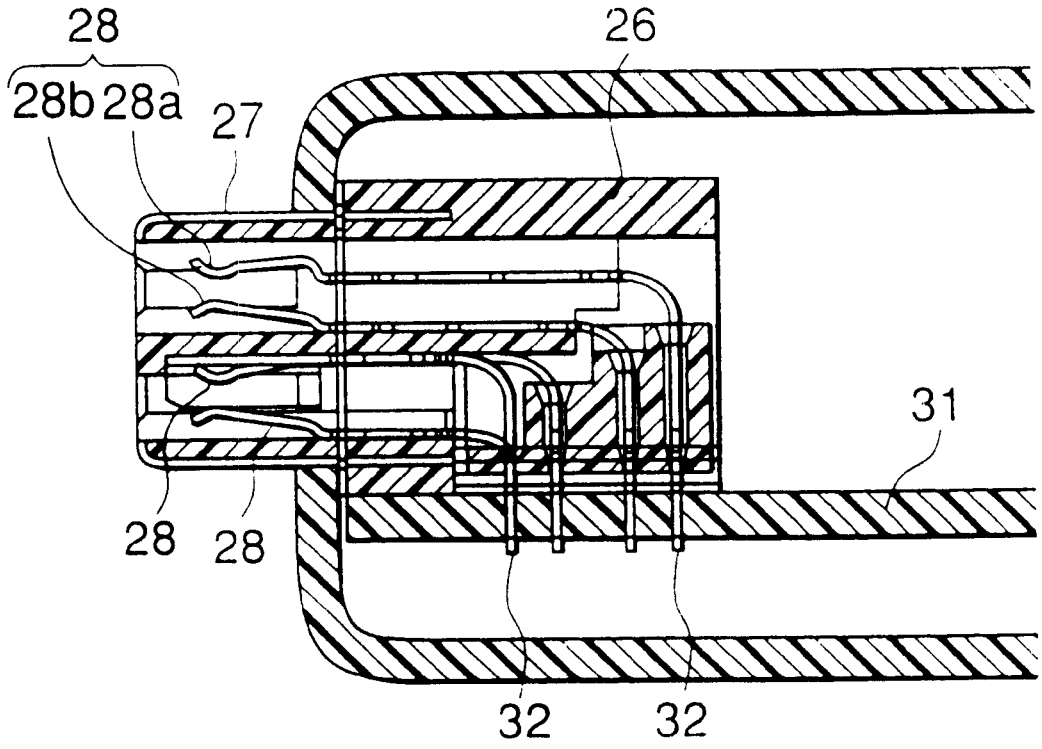
FIG. 5 is a sectional view of the connector illustrated in FIGS. 4A to 4C when it is connected to a board.

Now, description will be made of various embodiments of this invention with reference to the drawing.

At first referring to FIGS. 2A, 2B, 2C, and 3, description will be made of a connector according to a first embodiment of this invention.

The connector illustrated in the figures is a receptacle connector and comprises an insulator 21, a cylindrical conductive coupling portion 22 held by the insulator 21, and a plurality of conductive contacts 23 arranged within the coupling portion 22 and held by the insulator 21. The conductive contacts 23 are grouped into a plurality of contact groups 24 corresponding to intended uses, respectively, and adjacent to one another in a first direction A1. In each contact group 24, the conductive contacts 23 are arranged in a second direction A2 perpendicular to the first direction A1.

Among the contact groups 24, one of outermost contact groups located outermost in the first direction A1 is assigned to high-speed signals as a specific contact group. In the specific contact group, the conductive contacts 23 are classified into signal contacts 23*a* as signal paths and ground contacts 23*b* to be grounded. The signal contacts 23*a* are arranged in a first array while the ground contacts 23*b* are arranged in a second array adjacent to the first array in the first direction A1. The signal contacts 23*a* are adapted to be connected to signal wires of a shield cable, respectively. Each of the ground contacts 23*b* is adapted to be connected to a shield wire of the shield cable.

Each of the conductive contacts 23 substantially straightly extends in a third direction A3 perpendicular to the first and the second directions A1 and A2. Therefore, the connector of this type is called a straight-type connector. The specific contact group may be either one of the contact groups 24 located at opposite ends in the first direction A1.

The signal contacts 23*a* and the ground contacts 23*b* are connected to the shield cable through a relay connector 25. Specifically, each of the conductive contacts 23 of the specific contact group has a first contacting portion formed at one end in the third direction A3 to be connected to a mating connector and a second contacting portion formed at the other end in the third direction A3 to be connected to the relay connector 25.

Referring to FIGS. 4A, 4B, 4C and 5, description will be made of a connector according to a second embodiment of this invention.

The connector illustrated in the figures is also a receptacle connector and comprises an insulator 26, a cylindrical conductive coupling portion 27 held by the insulator 26, and a plurality of conductive contacts 28 arranged within the coupling portion 27 and held by the insulator 26. The conductive contacts 28 are grouped into a plurality of contact groups 29 corresponding to intended uses, respectively, and adjacent to one another in a first direction A1. In each contact group 29, the conductive contacts 28 are arranged in a second direction A2 perpendicular to the first direction A1.

Among the contact groups 29, one of outermost contact groups located outermost in the first direction A1 is assigned to high-speed signals as a specific contact group. In the specific contact group, the conductive contacts 28 are classified into signal contacts 28*a* as signal paths and ground contacts 28*b* to be grounded. The signal contacts 28*a* are arranged in a first array while the ground contacts 28*b* are arranged in a second array adjacent to the first array in the first direction A1. Each of the signal contacts 28*a* is adapted to be connected to a signal wire of a shield cable. Each of the ground contacts 28*b* is adapted to be connected to a shield wire of the shield cable.

Each of the conductive contacts 28 is folded at an end in the third direction A3 and extends therefrom in the first direction A1 towards a board 31 to form a board connecting portion 32 to be connected to the board 31.

Therefore, the connector of this type is called an angle-type connector. The specific contact group is a farthest one of the contact groups 29 which is farthest from the board 31.

Referring to FIGS. 6 to 10, various examples of connection will be described.

Figure 6:
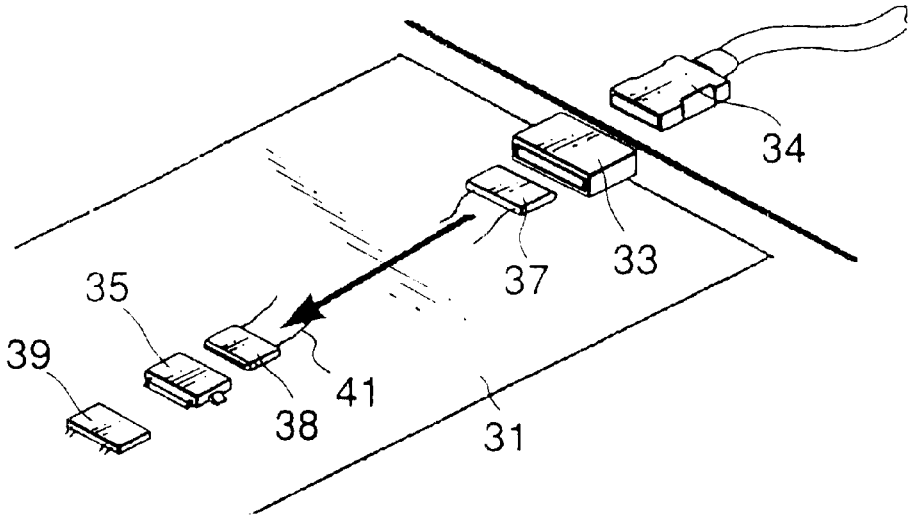
FIGS. 6 through 9 are perspective views for describing the use of the connectors in various cases.
Figure 7:
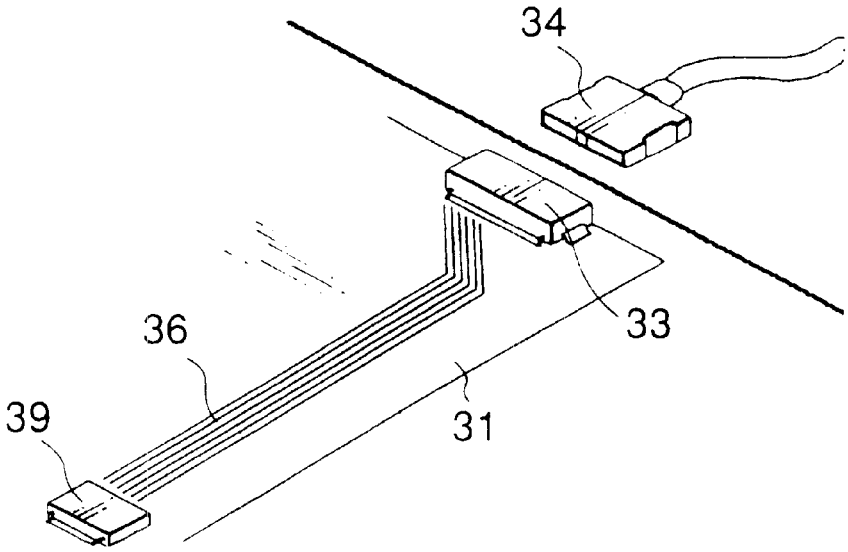

In the figures, a connector similar to the connector illustrated in FIGS. 4A to 4C and 5 is depicted by a reference numeral 33. Signal transmission by the use of the connector 33 and a mating connector 34 to be connected thereto may be carried out by relay connection as illustrated in FIG. 6 or by board mounting or board-through connection as illustrated in FIG. 7. In the relay connection, an appropriate circuit block including a connector 35 are inserted so as to readily prevent the disturbance in impedance resulting from crosstalk between board patterns. In the board mounting, the pitch of board patterns 36 is appropriately selected so as to prevent the disturbance in impedance resulting from the crosstalk. In the figures, reference numerals 37 and 38 represent relay connectors, 39, a transmission chip, and 44, a cable.

Figure 8:
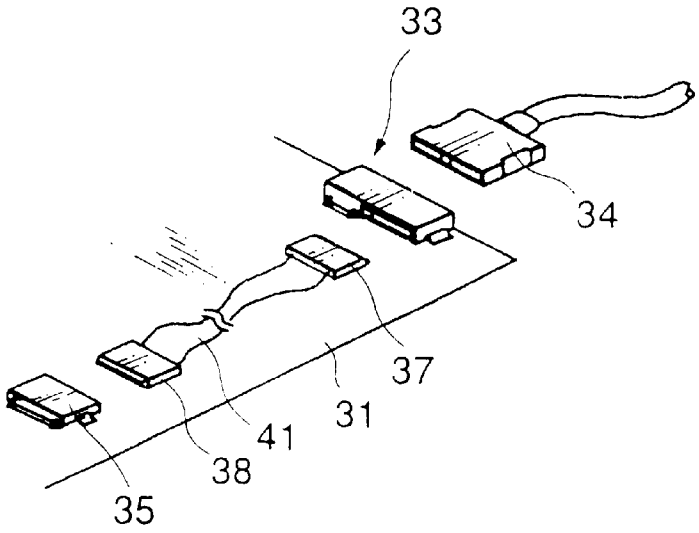

Referring to FIG. 8, the connector 33 comprises a structure including two kinds of the above-mentioned connectors integrally combined. With this structure, signal transmission can be carried out both by the board mounting and by the relay connection.

Figure 9:
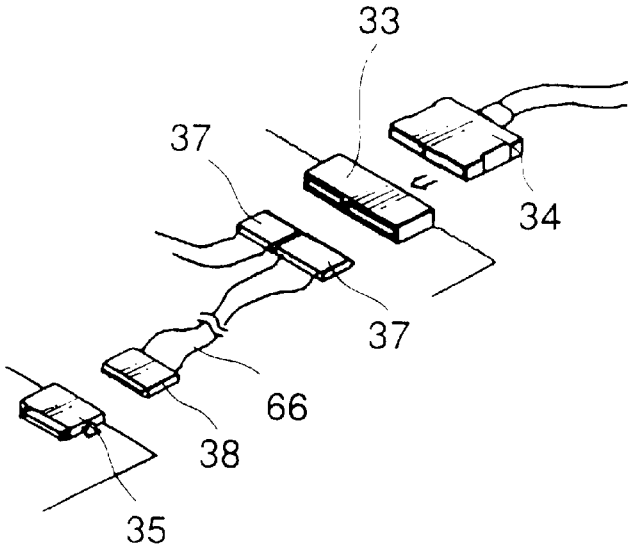

Referring to FIG. 9, the connector 33 is adapted to be connected to a plurality of circuit blocks or the connector 35.

Figure 10:
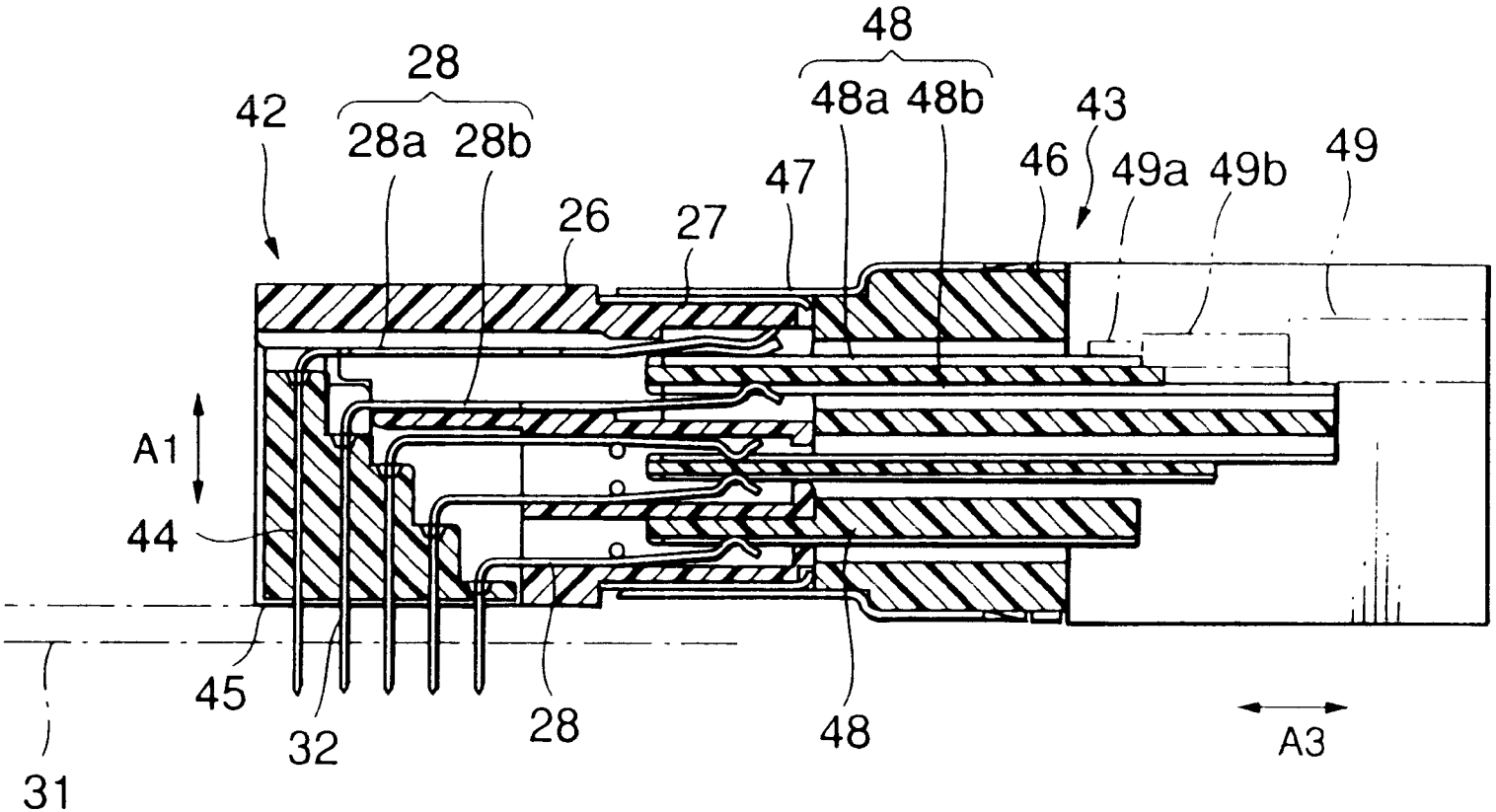
FIG. 10 is a sectional view of modifications of the connectors in FIGS. 2A to 2C and in FIGS. 4A to 4C when they are connected to each other.

Referring to FIG. 10, description will be made of a modification of the connector illustrated in FIGS. 4A to 4C and 5. Similar parts are designated by like reference numerals and will not be described any longer.

As illustrated in FIG. 10, an angle-type connector 42 is coupled and connected to a straight-type connector 43. In the angle-type connector 42, each of the signal contacts 28*a* in the specific contact group has a specific connecting portion 44 starting at one end in the third direction A3. The specific connecting portion 44 extends in the first direction A1 in parallel to the board connecting portion 32 and is connected to the board 31. The specific connecting portion 44 may has an end which serves as a surface mounting terminal 45 to be connected to the surface of the board 31.

The straight-type connector 43 comprises an insulator 46, a conductive cylindrical coupling portion 47 held by the insulator 46, and a plurality of conductive contacts 48 arranged within the coupling portion 47 and held by the insulator 46. The conductive contacts 48 are brought into contact with the conductive contacts 28 of the angle-type connector 42 in one-to-one correspondence. Therefore, the conductive contacts 48 corresponding to the specific contact group are classified into signal contacts 48*a* as signal paths and ground contacts 48*b* to be grounded. The signal contacts 48*a* are arranged in a first array while the ground contacts 48*b* are arranged in a second array adjacent to the first array in the first direction A1. Each of the signal contacts 48*a* is to be connected to a signal wire 49*a* of a shield cable 49. Each of the ground contacts 48*b* is to be connected to a shield wire 49*b* of the shield cable 49.

Figure 11:
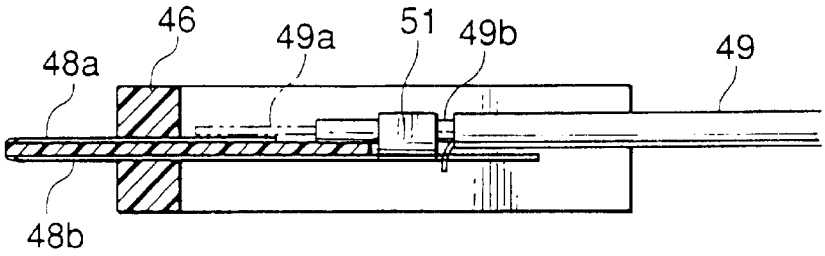
FIG. 11 is a view for describing connection of a shield cable to a signal contact and a ground contact of the connector of FIG. 10.
Figure 12A:
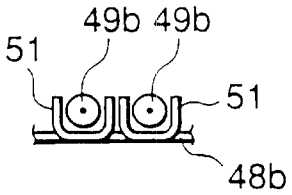
FIGS. 12A and 12B show surrounding portions formed on the ground contacts to surround the shield cables, respectively.
Figure 12B:
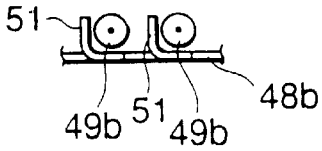
Figure 13:
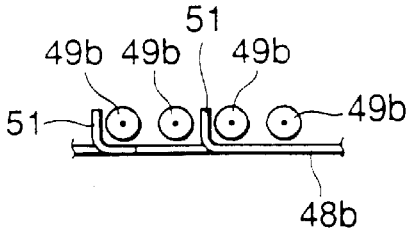
FIG. 13 shows a modification of the surrounding portions formed on the ground contacts together with the shield cables.

Referring to FIGS. 11 through 13, connection of the shield cable 49 will be described.

In order to connect the shield cable 49, the ground contact 48*b* is provided with a surrounding portion 51 for surrounding and positioning a part of the shield cable 49 where the shield wire 49*b* is exposed. The shield wire 49*b* has a lead portion directly connected to the ground contact 48*b* by soldering or the like. The surrounding portion 51 may be formed into a shape illustrated in FIGS. 12A, 12B, or 13.

Figure 14:
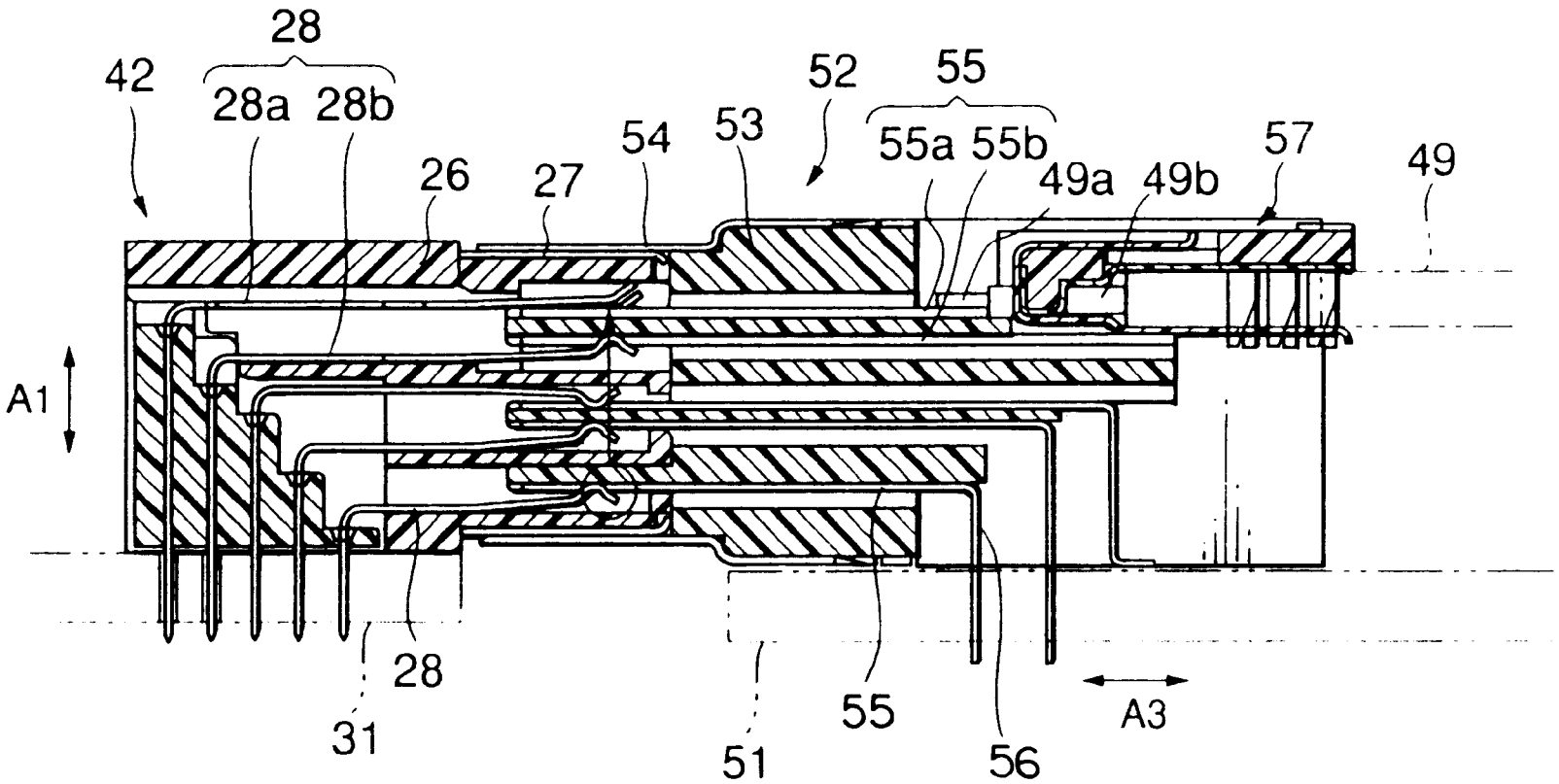
FIG. 14 is a sectional view of two modifications of the connector in FIGS. 4A–4C when they are connected to each other.

Referring to FIG. 14, description will be made of a modification of connection of the shield cable 49.

In FIG. 14, the angle-type connector 42 is coupled and connected to another angle-type connector 52. The connectors 42 and 52 are mounted on the board 31 and a board 51, respectively.

The connector 52 comprises an insulator 53, a cylindrical conductive coupling portion 54 held by the insulator 53, and a plurality of conductive contacts 55 arranged within the coupling portion 54 and held by the insulator 53. The conductive contacts 55 are brought into contact with the conductive contacts 28 of the connector 42 in one-to-one correspondence. Therefore, the conductive contacts 55 corresponding to the specific contact group are classified into signal contacts 55*a* as signal paths and ground contacts 55*b* to be grounded. The signal contacts 55*a* are arranged in a first array while the ground contacts 55*b* are arranged in a second array adjacent to the first array in the first direction A1. Each of the signal contacts 55*a* is adapted to be connected to the signal wire 49*a* of the shield cable 49. Each of the ground contacts 55*b* is adapted to be connected to the shield wire 49*b* of the shield cable 49. In other contact groups except the specific contact group, each of the conductive contacts 55 has a board connecting portion 56 starting at an end in the third direction A3 and extending in the first direction A1 towards the board 51 to be connected to the board 51.

In the specific contact group, each of the conductive contacts 55 is of a straight type and has a first contacting portion formed at one end in the third direction A3 to be brought into contact with the conductive contact 28 of the connector 42 and a second contacting portion formed at the other end in the third direction A3 to be connected to the shield cable 49.

In order to connect the shield cable 49 to the second contacting portion of the conductive contact 55 of the connector 52, use is made of a locator 57 separate from the conductive contacts 55. The locator 57 places the shield cable 49 in proper position and is engaged with the insulator 53. The locator 57 connects the signal wire 49*a* and the shield wire 49*b* of the shield cable 49 to the signal contact 55*a* and the ground contact 55*b*, respectively.

The locator 57 comprises an insulator 58 and a conductive portion 59 held by the insulator 58 and connected to the shield wire 49*b*. By bringing the conductive portion 59 into contact with the ground contact 55*b* with the sliding movement in the third direction A3, the shield wire 49*b* is connected to the ground contact 55*b*. In this state, the locator 57 is engaged with the insulator 53 and the signal wire 49*a* is connected to the signal contact 55*a*.

Figure 15:
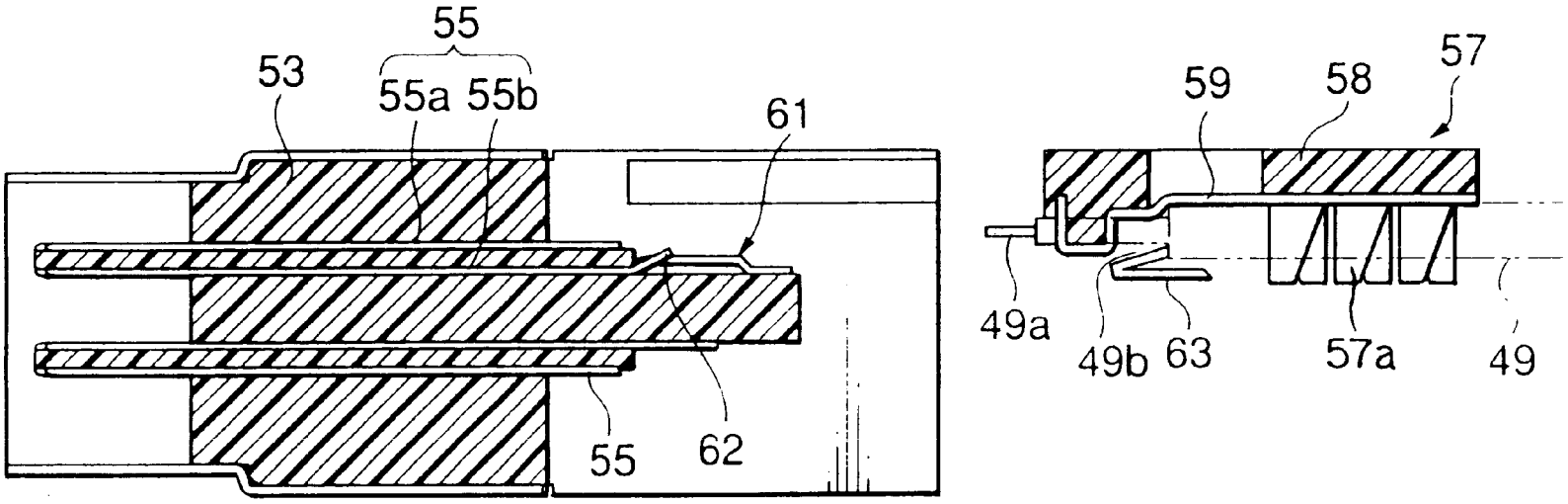
FIG. 15 is a sectional view for describing connection of the shield cable to the connector by the use of a locator and shows a state before connection.
Figure 16:
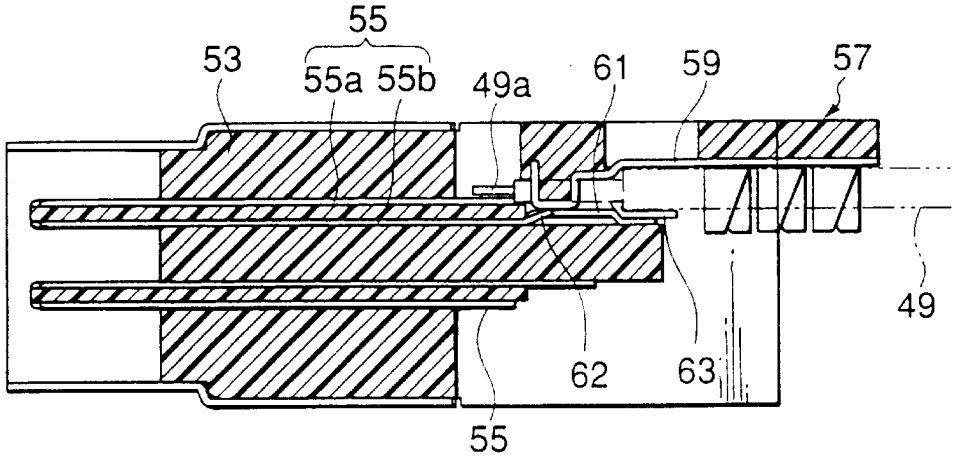
FIG. 16 is a sectional view similar to FIG. 15 but shows a state after connection.

Referring to FIGS. 15 and 16, description will be made of another modification of connection of the shield cable 49.

The ground contacts 55*b* alternately have a processing portion 61 for assisting a contacting operation of the shield wire 59*b* and a spring portion 62 to be brought into press contact with the conductive portion 59. On the other hand, the shield wire 49*b* is provided with a lead portion 63.

The locator 57 with the shield cable 49 connected thereto as illustrated in FIG. 15 is coupled to the connector 51 as illustrated in FIG. 16. In this event, the conductive portion 59 is put into press contact with the spring portion 62 and the lead portion 63 is brought into contact with the processing portion 61. Thus, the shield wire 49*b* is connected to the ground contact 55*b*. The signal wire 49*a* is connected to the signal contact 55*a* by soldering or the like.

As illustrated in FIG. 15, the locator 57 may be provided with envelope portions 57*a* for surrounding and positioning the shield cable 49. Alternatively, the locator 57 may be provided with a surrounding portion for surrounding and positioning a part of the shield cable 49 where the shield wire 49*b* is exposed.

Figure 17:
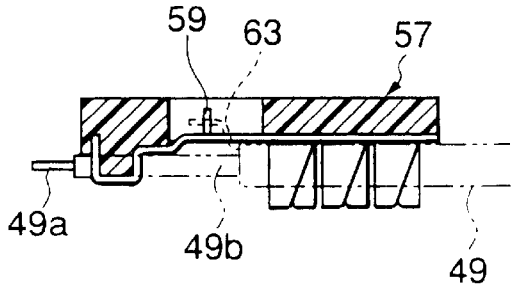
FIG. 17 is a sectional view of a modification of connection between the locator and the shield cable.

Referring to FIG. 17, the lead portion 63 of the shield wire 49*b* may be connected to the conductive portion 59 of the locator 57 by press contact, crimping, or soldering.

Figure 18:
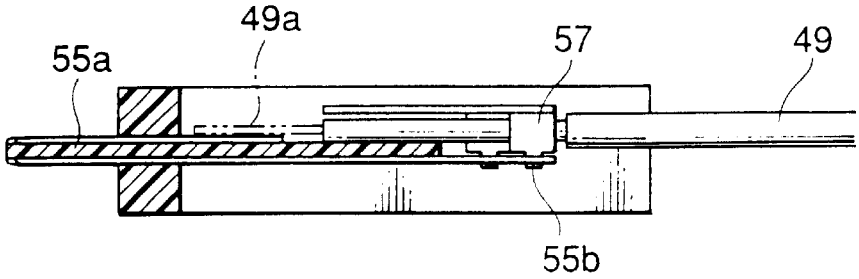
FIG. 18 is a sectional view of another modification of connection between the locator and the shield cable.

Referring to FIG. 18, a part 59*a* of the conductive portion 59 of the locator 57 is inserted into a hole of the ground contact 55*b* to establish electrical connection between the conductive portion 59 and the ground contact 55*b*.

Figure 19:
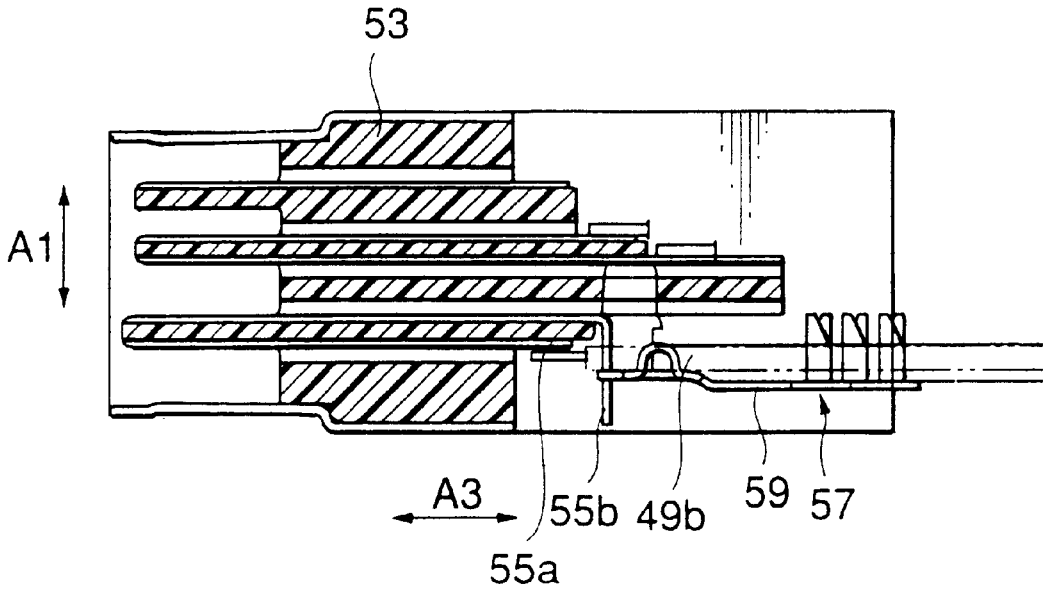
FIG. 19 is a sectional view of a connector according to another embodiment of this invention.
Figure 20:
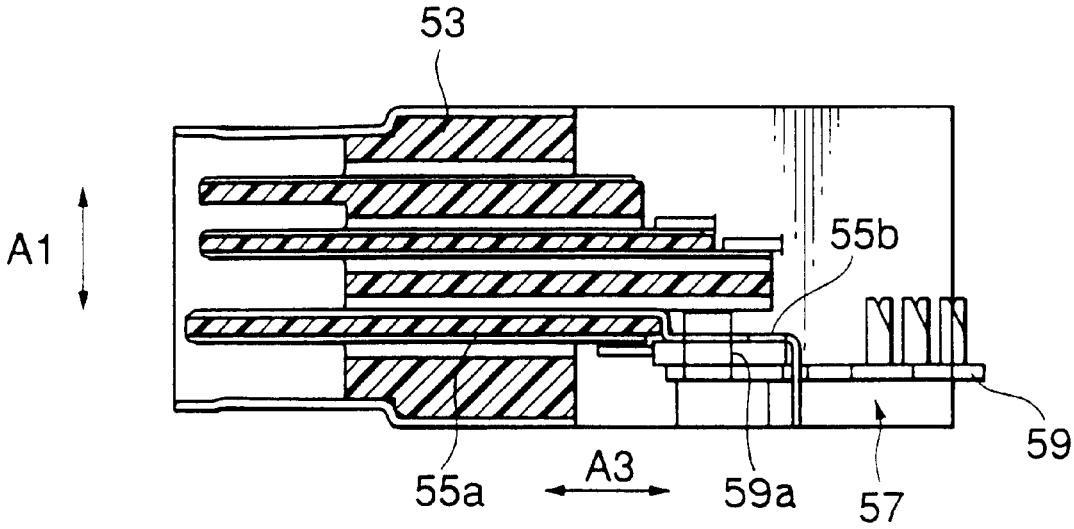
FIG. 20 is a sectional view of a connector according to still another embodiment of this invention.

Referring to FIGS. 19 and 20, the conductive portion 59 of the locator 57 may be inserted into the hole of the ground contact 55*b* in the third direction A3 (FIG. 19) or in the first direction A1 (FIG. 20).

Figure 21:
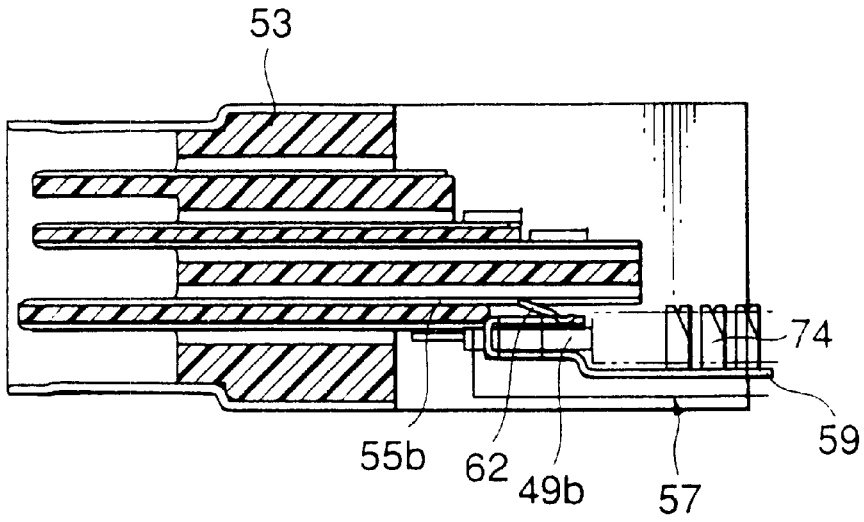
FIG. 21 is a sectional view of a connector according to yet another embodiment of this invention.

Referring to FIG. 21, electrical connection between the shield wire 49*b* and the ground contact 55*b* may be established via the spring portion 62 of the ground contact 55*b*.

In the structure illustrated in each of FIGS. 19 through 21, the specific contact group is located at a lower part of the connector 52.

Figure 22:
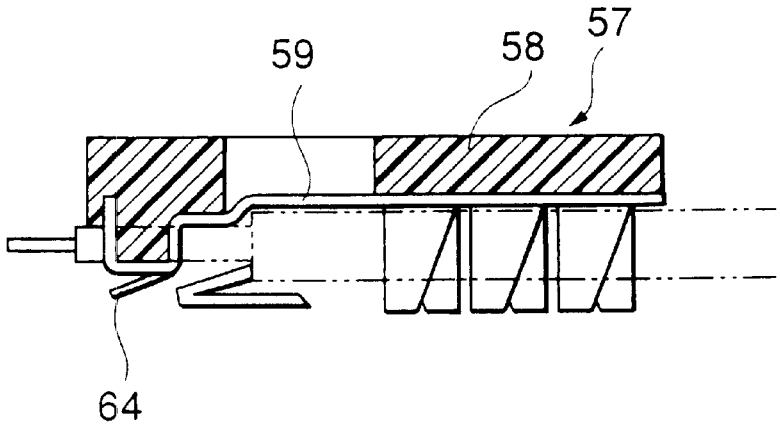
FIG. 22 is a sectional view showing a modification of the locator.

Referring to FIG. 22, the conductive portion 59 of the locator 57 may be provided with a spring portion 64 instead of the spring portion 62 of the ground contact 55*b* in FIG. 15.

Figure 23:
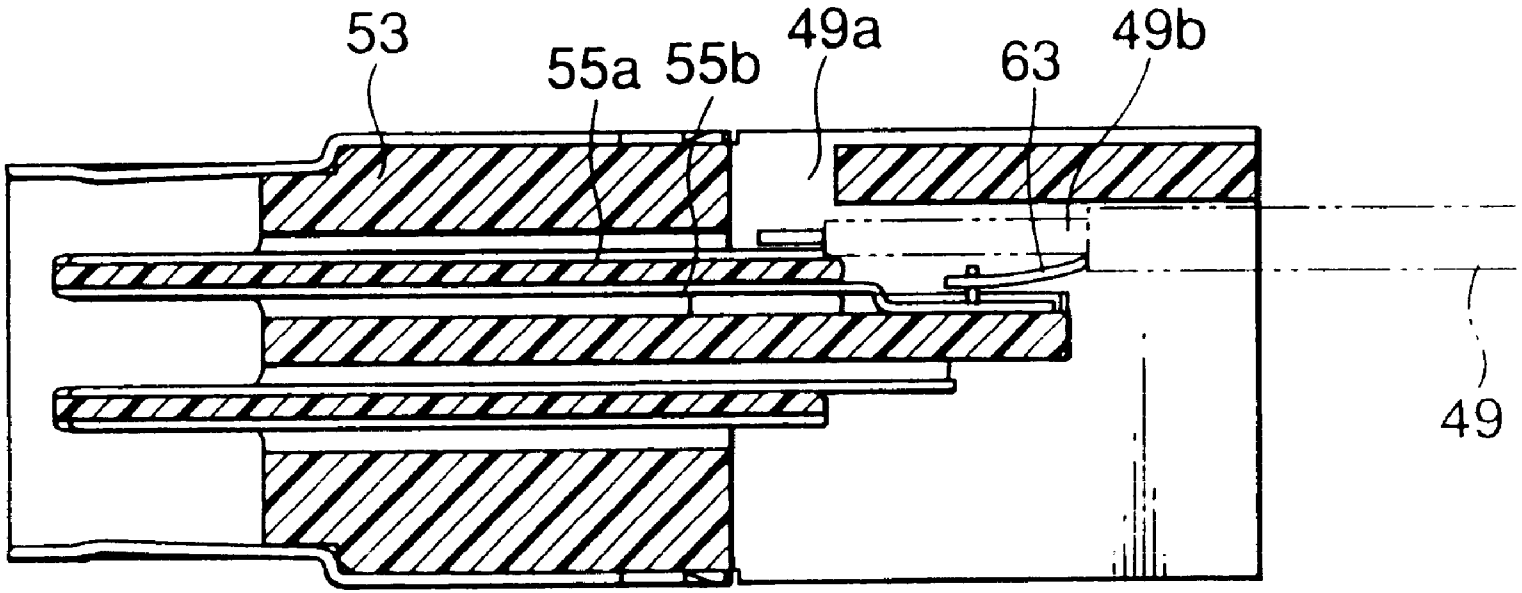
FIG. 23 is a sectional view for describing a modification of connection of a shield wire of the shield cable to the ground contact.

Referring to FIG. 23, the lead portion 63 of the shield wire 49*b* may be directly connected to the ground contact 55*b* by press contact, crimping, or soldering.

Figure 24:
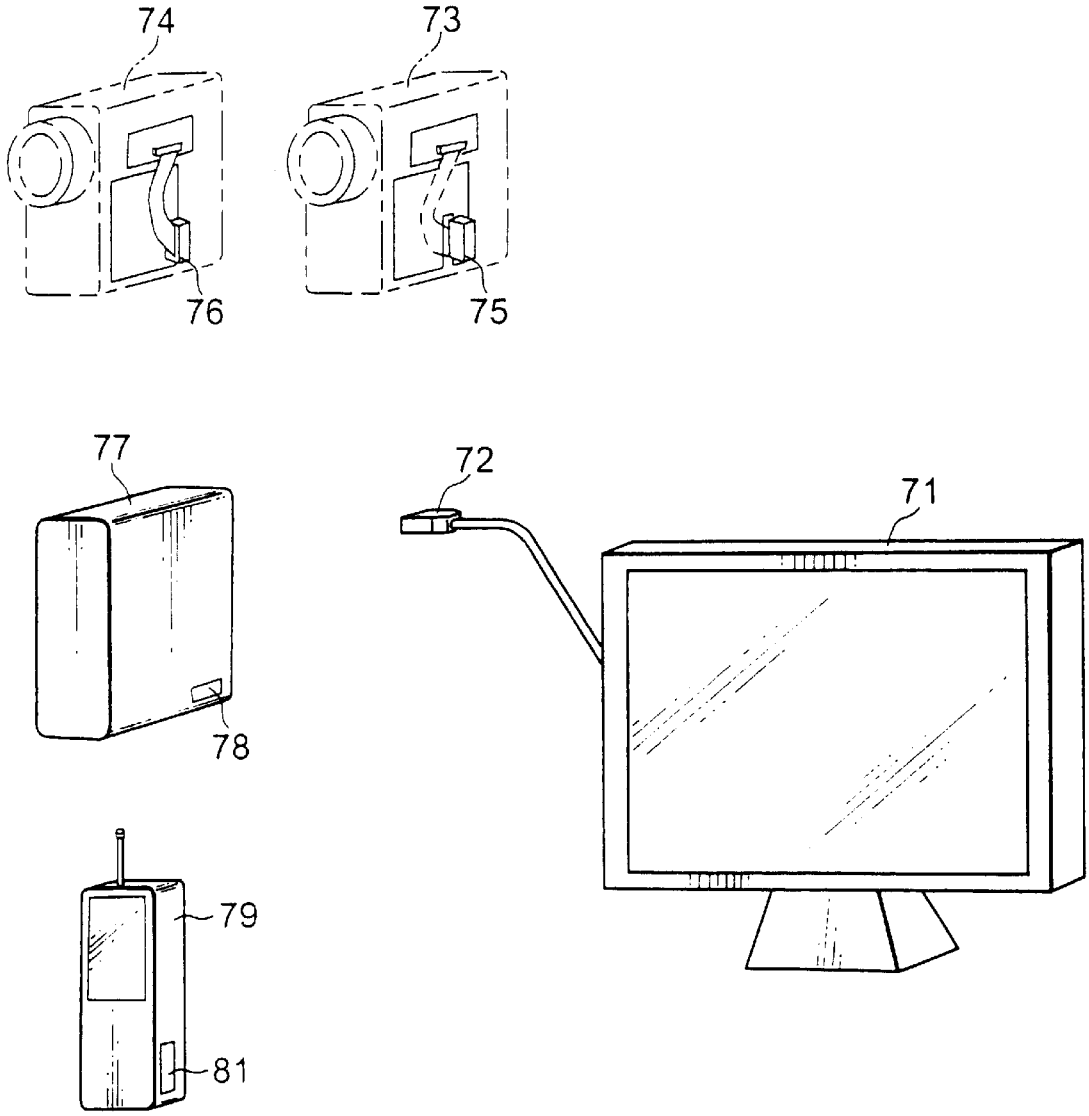
FIG. 24 is a view for describing an example of use of the connector according to this invention.

Referring to FIG. 24, description will be made of an example of practical application of this invention.

A display 71 is connected to a connector 72 including a number of contacts arranged within a coupling portion and grouped into a plurality of groups in correspondence to intended uses, respectively, like the above-mentioned connector. On the other hand, DVCs (Digital Video Cameras) 73 and 74 are provided with connectors 75 and 76, respectively. A game apparatus 77 is provided with a connector 78. A mobile telephone apparatus 79 is provided with a connector 81. Each of these connectors 75, 76, 78, and 81 can be connected to each corresponding contact group of the connector 72. With this structure, the DVC 73 or 74, the game apparatus 77, or the mobile telephone apparatus 79 can be selectively connected to the connector 72 connected to the display 71. Thus, the display 71 is simplified in its connector arrangement. The connector 75 is of a straight type while the connector 76 is of an angle type.

Herein, description is directed to the case where the display is connected to the DVC, the game apparatus, or the mobile telephone apparatus. However, it will readily be understood that this invention is also applicable to connection of various other apparatuses or devices.

As described above, according to this invention, it is possible to provide the connector in which the contacts are grouped into groups corresponding to the intended uses, respectively, in the manner adapted to transmission of high-speed signals and to provide an information processing apparatus equipped with the connector.

What is claimed is:

1. A connector comprising:

an insulator; and a number of conductive contacts held by the insulator;

the contacts being grouped into a plurality of contact groups corresponding to intended uses, respectively, and adjacent to one another in a first direction;

the contacts in each contact group being arranged in a second direction perpendicular to the first direction;

the contact groups including a specific contact group which is located outermost in the first direction and assigned to high-speed signals;

wherein the conductive contacts include:

signal contacts serving as signal paths, and ground contacts to be grounded;

the specific contact group including: a first array comprising the signal contacts, and a second array comprising the ground contacts and adjacent to the first array in the first direction; and a conductive locator separate from the ground contact and serving to position a shield cable, the locator being connected to a shield wire of the shield cable and being connected and disconnected to and from the ground contact.

2. The connector according to claim 1, wherein:

each of the conductive contacts extends in a third direction perpendicular to the first and the second directions, and the specific contact group is either one of the contact groups at opposite ends in the first direction.

3. The connector according to claim 2, wherein:

each of the conductive contacts in other contact groups except the specific contact group has a board connecting portion starting from an end of the contact in the third direction;

the board connecting portion extends in the first direction away from the specific contact group to be connected to a board, and the specific contact group is one of the contact groups which is farthest from the board.

4. The connector according to claim 2, wherein each of the conductive contacts in the specific contact group has:

a first contacting portion formed at one end in the third direction to be connected to a mating connector; and a second contacting portion formed at the other end in the third direction to be connected to a relay connector.

5. The connector according to claim 3, wherein:

each of the conductive contacts in the specific contact group has a specific connecting portion starting from the end of the contact in the third direction; and the specific connecting portion extends in the first direction in parallel to the board connecting portion to be connected to the board.

6. The connector according to claim 3, wherein the specific connecting portion has a surface mount terminal to be connected to the surface of the board.

7. The connector according to claim 1, wherein:

each of the ground contacts is adapted to be connected to a shield wire of a shield cable; and each of the ground contacts is provided with a surrounding portion surrounding and positioning a part of the shield cable where the shield wire is exposed.

8. The connector according to claim 1, further comprising a locator separate from the ground contact, the locator serving to position the shield cable and to connect and disconnect the shield wire of the shield cable to and from the ground contacts.

9. The connector according to claim 8, wherein the locator is provided with a surrounding portion surrounding and positioning a part of the shield cable where the shield wire is exposed.

10. The connector according to claim 8, wherein each of the ground contacts has a processing portion for assisting a contacting operation of the shield wire.

11. The connector according to claim 1, wherein the locator is connected and disconnected to and from the ground contact with sliding movement.

12. The connector according to claim 11, wherein the ground contact has a spring portion to be brought into contact with the locator.

13. The connector according to claim 1, wherein the locator has a spring portion to be brought into contact with the ground contact.

* * * * *